US007014363B2

(12) United States Patent
Hanson

(10) Patent No.: US 7,014,363 B2
(45) Date of Patent: Mar. 21, 2006

(54) PLASTIC GUSSET BAG WITH CLOSURE AND CUT-OUT HANDLE

(76) Inventor: Violet Hanson, P.O. Box 68, Old Bethpage, NY (US) 11804

( * ) Notice: Subject to any disclaimer, the term of this patent is extended or adjusted under 35 U.S.C. 154(b) by 53 days.

(21) Appl. No.: 10/322,545

(22) Filed: Dec. 19, 2002

(65) Prior Publication Data

US 2004/0120613 A1 Jun. 24, 2004

(51) Int. Cl.
*B65D 30/20* (2006.01)

(52) U.S. Cl. ..... 383/120; 383/10; 383/43; 383/63; 383/104; 383/103; 383/106

(58) Field of Classification Search ..... 383/10, 383/61.2, 120, 43, 104, 63, 100–103, 106, 383/906–907
See application file for complete search history.

(56) References Cited

U.S. PATENT DOCUMENTS

| | | | | | |
|---|---|---|---|---|---|
| 1,665,576 | A | * | 4/1928 | Witham | 383/43 |
| 1,973,956 | A | * | 9/1934 | Hickman | 383/43 |
| 2,040,337 | A | * | 5/1936 | Rosmait | 383/45 |
| 2,822,012 | A | * | 2/1958 | Gold | 383/34 |
| 3,201,030 | A | * | 8/1965 | Pollack | 383/43 |
| 3,367,380 | A | * | 2/1968 | Dickey | 383/104 |
| 4,913,561 | A | * | 4/1990 | Beer | 383/94 |
| 4,997,104 | A | * | 3/1991 | Pohl | 229/117.34 |
| 5,037,138 | A | * | 8/1991 | McClintock et al. | 383/34 |
| 5,364,189 | A | * | 11/1994 | Kuge et al. | 383/61.2 |
| 5,465,842 | A | * | 11/1995 | Utley | 206/390 |
| 5,788,378 | A | * | 8/1998 | Thomas | 383/63 |
| 6,030,123 | A | * | 2/2000 | Mitarai | 383/63 |
| 6,126,315 | A | * | 10/2000 | Ichikawa et al. | 383/43 |
| 6,457,863 | B1 | * | 10/2002 | Vassallo | 383/43 |
| 6,461,043 | B1 | * | 10/2002 | Healy et al. | 383/204 |

FOREIGN PATENT DOCUMENTS

| | | | | |
|---|---|---|---|---|
| CH | 0332823 | * | 11/1958 | 383/26 |
| CH | 0453872 | * | 6/1968 | 383/93 |
| JP | 5-97151 | * | 4/1993 | 383/61.2 |
| JP | 406179454 A | * | 6/1994 | 383/104 |
| JP | 9-216642 | * | 8/1997 | 383/61.2 |

* cited by examiner

*Primary Examiner*—Jes F. Pascua
(74) *Attorney, Agent, or Firm*—Bernard S. Hoffman

(57) ABSTRACT

A tubular sleeve having an open top, a closed bottom wall, a front and back faces and a pair of opposing side walls connecting the front and back faces. The side walls are formed with at least one gusset allowing the front and back faces to extend from each other.

The gussets are sealed unitarily at the bottom ends to form the bottom wall. The "square bottom" bag takes on a triangular lengthwise shape normally biased closed at the top but easily openable for maximum filling and discharge of the interior of the bag.

14 Claims, 2 Drawing Sheets

PLASTIC GUSSET BAG WITH CLOSURE AND CUT-OUT HANDLE

RELATED APPLICATIONS

The present application contains disclosures found in applicant's earlier in U.S. Pat. No. 3,988,970, U.S. Pat. No. 3,916,770 and U.S. Pat. No. 4,230,300 issued a "square bottom" or "flat bottom" plastic bag and Provisional Patent Application No. 60/365,028 dated Mar. 18, 2002 and Disclosure Documents #492644 dated Apr. 23, 2001 and No. 492645 dated Apr. 23, 2001.

BACKGROUND OF THE INVENTION

The present invention relates to the closure of open top, thin plastic, gussetted bags including a "square bottom" plastic bag, "T" shirt bag and any top opening bag with side gussets formed of thin plastic material.

Plastic gussetted "square bottom" or "flat bottom" bags and regular gussetted bags have supplanted paper bags for use in super markets, retail establishments, and other establishments. These bags utilize the entire space of the plastic bag, stand up right by itself and is self-supporting so that it makes loading and unloading the bag easier.

This heretofore not available new closure will enable such plastic bags to have many uses apparent to the user and the reader of this application.

This bag may be used to hold products in markets, such as, food, deli counter operations, dog food and the like as well as boxed and canned goods. While made of flexible plastic material may be made of sturdy and strong, i.e., heavy wall construction that the filled bag may be conveniently carried. It would also be extremely beneficial to provide means for automated closing the open top after the bag is filled.

It is the object of this present invention to close a "flat bottom" or "square bottom" gussetted bag, after being filled, at the upper edge of the bag while allowing a maximum opening for filling and discharge of the bag.

Another object of this present invention is to provide the bag for use for liquids, solids, semi solids, frozen and defrosted items while maintaining the integrity of the self-standing bottom plastic gussetted sack or bag.

It is another object to provide a "flat bottom" bag with automatic top closure having a carrying handle. The objects as well as other objects and advantages will be obvious from the following disclosures.

SUMMARY OF THE INVENTION

In my prior patents, U.S. Pat. Nos. 3,988,970, 3,916,770 and 4,230,300, I disclosed plastic bags and their manufacture in which a flat bottom has been formed. The "flat" or "square bottom" bag is formed from a tubular sleeve having gussets on each side. A long transverse seal is applied to the bottom of the tube to form a bag. An internal opening mechanism is provided to open and "square off" the bottom Two bottom seals are applied to reinforce the bottom of the bag. Further, square bottom serve to allow the bag to be neatly folded for stacking and shipping. The bags shown in these patents also have side gussetts similarly designed to allow folding and stacking for shipping.

According to the present invention a gussetted bag of the type shown in my earlier patents containing a tubular sleeve having an open top, a closed bottom wall, a front and back faces and a pair of opposing side walls connecting the front and back faces is improved. The side walls are formed with at least one fold creating in the side walls at least one gusset allowing the front and back faces to extend from each other. The gussets are sealed unitarily at the bottom ends of the bottom wall, sealed through and through along their top edges of the the front and back faces inwardly respective from the side wall. Then, as will be seen the "square bottom" bag takes on a triangular lengthwide shape normally biased closed at the top but easily openable for maximum full and discharge of the interior of the bag.

Full details of the present invention are set forth in the following disclosure and shown in the accompanying drawings.

BRIEF DESCRIPTION OF DRAWINGS

In the drawings:

FIG. 2 is a view showing the discharge of goods from the interior thereof.

DESCRIPTION OF THE INVENTION

Figure 1:
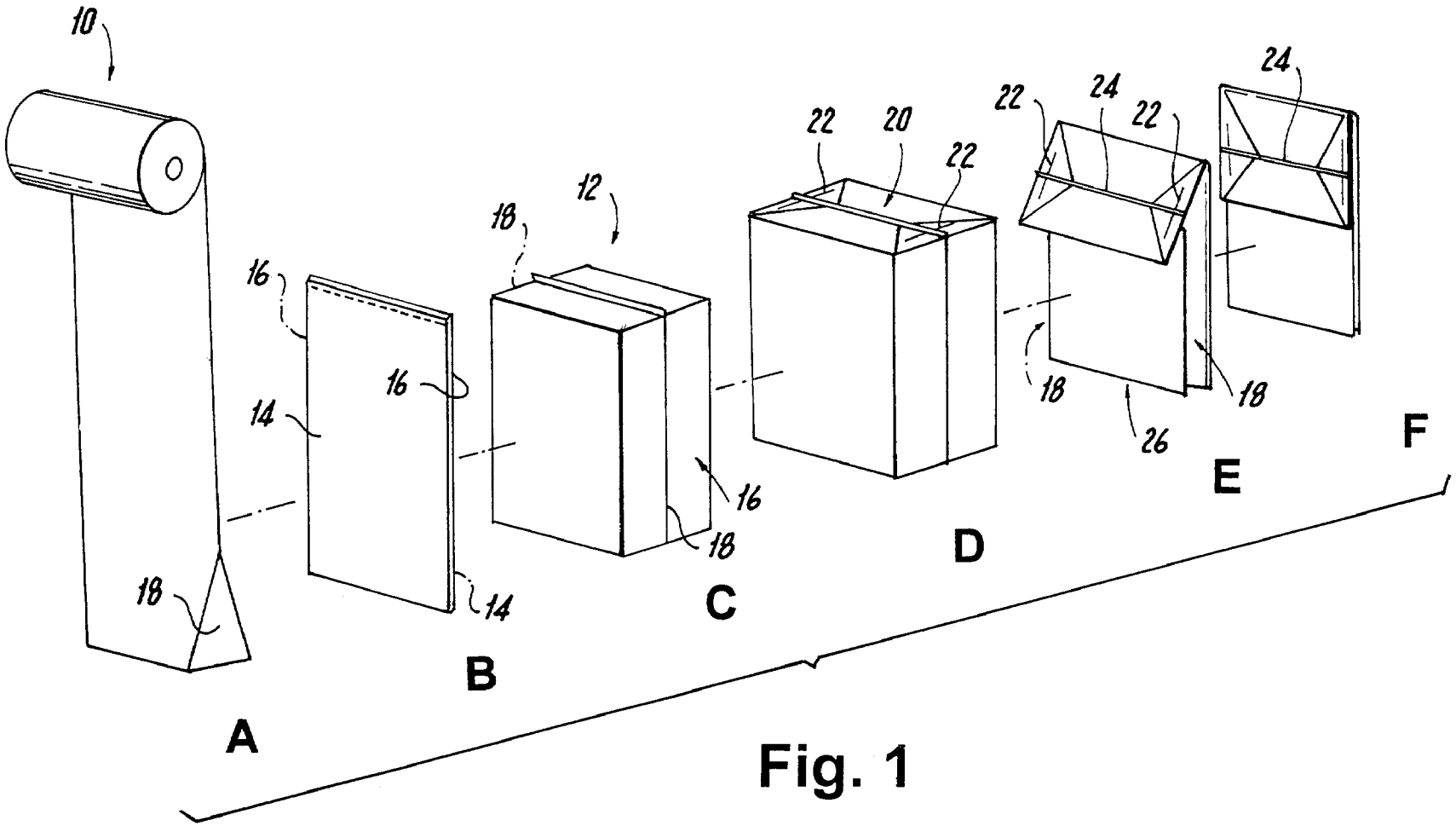
FIG. 1 is a series perspective views showing the construction of a flat bottom tubular bag.

Seen in FIG. 1, a typical endless roll plastic of tubular sleeve construction 10 used to form the initial bag 12 to which the invention is applied to. In step A, a portion of the endless tubular sleeve is shaped in accordance with the afore mentioned patents, to which reference can be made as if more fully set forth. The sleeve is cut in Step B, to have a rectangle shape with a transverse cross section having a pair of opposing faces 14 and a pair of side walls 16. Each side wall 16 is formed with at least a one longitudinal gussets 18 although two pair are preferred. The gussets 18 are folded inwardly and the tubular sleeve flattened by pressing the the opposing faces 14 in together. Then, in Step C, the plastic bag is opened and a "former" or mandrel is moved into the bag 14 so as to "square off" the bottom to make a "flat bottom" 20. In Step D, bottom seals 22 (one on each side of the bottom) are applied to seal the bottom to the side walls 16 making the "square bottom" rigid. As seen in Step E and F, the bag is then sealed with a seam 24 from side wall to side wall at the bottom with a heat sealing mechanism making the "T" shirt bag leaving the top open ended as at 26 bag.

Figure 2:
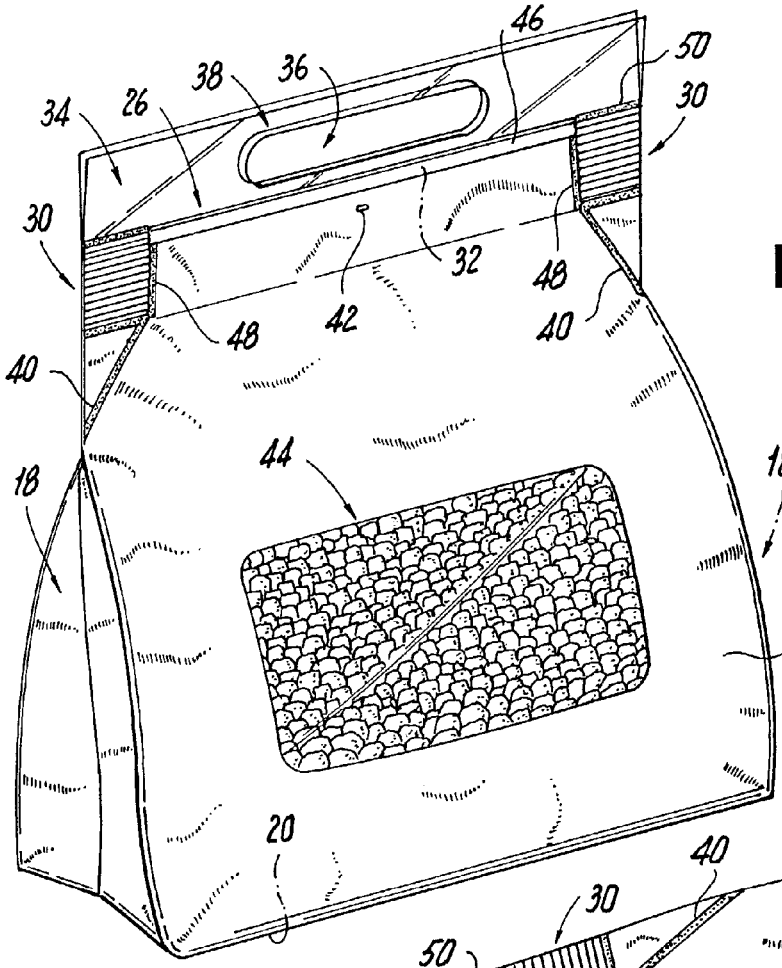
FIG. 2 is perspectal view of a flat bottom bag having the gusset construction of the present invention.
Figure 3:
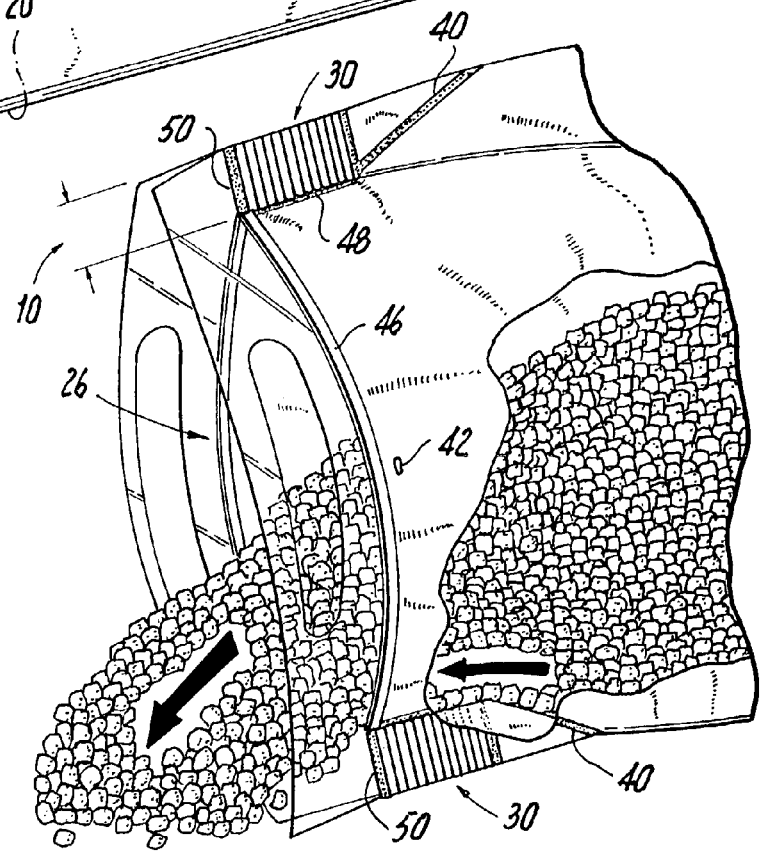
FIG. 3 is a view of the bag invention, on its side.

Turning to FIGS. 2 and 3, the present invention provides the top edge 26 with a closure seal 46 applied to limit of the length of gusset sides 18. The reduced gussets sides 18 are made as small as as possible without interfering with the required size of the bag and integrity of the "square bottom" or "flat bottom" 20. After the gusset sealing is completed all the gusset faces are pressed together and sealed at the top end of the bag with at least one or two band seals 30 including longitudinal seal 48 sealing the pressed gusset faces completely through the film or sheet of plastic.

The top edge 26 of each face may be reinforced with stay 32 of bendable material, such as a corset stay so the bag automatically closes. Also a band 34 integral with the front and rear faces 14 to extend upward longitudinal seal extends from the gussets upward therefrom an opening 36 is fashioned in the band 34 establishing a handle 38. Below the handle, along the top of the bag itself, a zipper or other closure device 46 may be placed, so that the contents of the bag can be locked and held for shipment.

The number of seals 30 on each side gusset 18 can be selected as desired along with the longitudinal seal 48. At least one diagonal seal 40 is made at the bottom end of the longitudinal seal 48 on each side of the bag. These diagonal seals 40 made at the end of the longitudinal seal 48 reinforce the longitudinal seal and enable the easy flow of goods out of the bag. (See FIG. 3)

The block seals 30 are made near the top of the bag to insure that the bag is not torn when filling or emptying out. These block seals also allow the user a place or location to grasp the bag at time of opening, closing the bag and discharging the contents at time of unloading bags. Block seals are applied simultaneously when the long longitudinal seal and diagonal seals are made through all the side gussets. As a matter of fact, all foregoing seals (30,40,48) can be made at one time. Once the gusset seals, block seals, longitudual and diagonal seals are in place, the band and a zipper closure with cut-out handle maybe formed to the upper portion of the bag separately by sealing a portion of the flap of the zipper closure to the front and back of the new construction sealed bag.

If made separately, the entire upper portion of the bag containing the cut-out handle and zipper closure is heat sealed to the upper portion of lower bag. The additional block seal 50 is to prevent the zipper from opening past the gussetted sealed upper portions of the bag itself.

Further a small slit 42 is made in the bag at a location below the top edge closure. This will enable the easy flow of material in and out of the bag allow air to also blow out of bag.

As seen in detail in FIGS. 2 & 3, all gusset members are sealed together. All gusset sides are pressed and all seals are applied including the long longitudinal seal and diagonal seal are applied at one time. The seals are made on both sides of the bag. FIG. 2 shows the smaller gussetted sides 18 to allow for a larger opening to load and unload any material in the bag. Note the reduced gusset side size 10 is to allow for maximum opening of the bag without destroying the integrity of the gussetted "square bottom" "flat bottom" bag.

FIGS. 2 and 3 clearly show the small slit 42 made in the bag to allow air to escape from the bag at time of loading, as well as the zipper closure to the bag along with a cut-out handle. The block seal 50 on the zipper portion of the closure is also clearly shown.

As seen from the foregoing, a "flat bottom" plastic bag be constructed of any desired size and for any selected use and function. The plastic film from which the bag is constructed can be transparent or opaque to allow for identifying and merchandising material. Seen in FIGS. 2 and 3, a translucent film having a transparent window 44 is shown. The resultant bag has a triangular tubular shape. The "flat bottom" being larger in girth through the body of the bag, thereby allowing the bag to stand upright with the top distended to allow access and egress of material Similarly, the bag can be placed on its side as seen in FIG. 3.

Furthermore, the bag allows the addition of a handle and a locking zipper or other closure device. Thereby, the resultant bag may be used as a handbag, pocket book or satchel tote.

Thus the scope of the disclosure should not be seen as limiting this invention should be derived only from the appended claims.

What is claimed:

1. A gusset bag, comprising:

a) a front wall;

b) a back wall;

c) a pair of opposing side walls;

d) a bottom wall;

e) atop;

f) a pair of block seals;

g) a pair of diagonal seals; and h) a stay;

wherein said bottom wall is closed;

wherein said pair of opposing side walls and said bottom wall connect said front wall to said back wall;

wherein said pair of opposing side walls have gussets;

wherein said top defines a mouth;

wherein said pair of block seals seal said front wall to said back wall, sealing an associated gusset therebetween;

wherein said pair of diagonal seals seal said front wall to said back wall, sealing an associated gusset therebetween;

wherein said pair of blocks seals are separate and distinct from said pair of diagonal seals;

wherein said stay extends along said mouth; and wherein said stay normally biases said mouth closed and thereby automatically closes said mouth.

2. The bag as defined in claim 1 wherein said stay is made of a resilient material.

3. The bag as defined in claim 1 wherein said mouth has a pair of terminal ends; and wherein said pair of block seals are disposed at said pair of terminal ends of said mouth, respectively, for insuring that said bag is not torn when filling or emptying and for providing a place to grasp said bag at time of opening, discharging, and closing.

4. The bag as defined in claim 1 wherein said mouth has a pair of terminal ends; and wherein said pair of diagonal seals depend diagonally outwardly from said pair of terminal ends of said mouth to said pair of side walls, respectively, for enabling easy flow of goods out of said bag.

5. The bag as defined in claim 1 wherein said bag is made of plastic.

6. The bag as defined in claim 1 wherein said bag stands upright by itself and is self-supporting for ease of loading and unloading of said bag.

7. The bag as defined in claim 1 further comprising a carrying handle; and wherein said carrying handle is disposed at said top.

8. The bag as defined in claim 7 wherein said carrying handle is disposed above said mouth.

9. The bag as defined in claim 7 wherein said carrying handle is formed by cut-outs through said front wall and said back wall.

10. The bag as defined in claim 1 wherein one of said front wall and said back wall has a through bore for allowing air to escape from said bag at time of loading.

11. The bag as defined in claim 1 wherein one of said front wall and said back wall has a window for identifying contents of said bag.

12. The bag as defined in claim 1 wherein said bottom is squared off and flat so as to allow said bag to be neatly folded for stacking and shipping.

13. The bag as defined in claim 1 further comprising a closure; and wherein said closure is operatively connected to said mouth for maintaining said mouth closed.

14. The bag as defined in claim 13 wherein said closure is a zipper.

* * * * *